United States Patent [19]

Gray

[11] 3,945,632

[45] Mar. 23, 1976

[54] MACHINE FOR ASSEMBLING FLEXIBLE WORKPIECES

[75] Inventor: Richard W. Gray, Marblehead, Mass.

[73] Assignee: USM Corporation, Boston, Mass.

[22] Filed: May 22, 1973

[21] Appl. No.: 362,835

[52] U.S. Cl. ..... 270/52; 112/121.12

[51] Int. Cl.[2] ..... B65H 39/00

[58] Field of Search ..... 270/52, 58, 59, 60; 156/364; 112/121.11, 121.12; 223/2; 271/9–13, 18–19

[56] References Cited

UNITED STATES PATENTS

| | | | |
|---|---|---|---|
| 3,522,129 | 7/1970 | Crathern | 270/59 |
| 3,603,463 | 9/1971 | Billett | 270/58 |
| 3,617,054 | 11/1971 | Schilling | 270/58 |
| 3,656,740 | 4/1972 | Takatou | 270/58 |
| 3,785,508 | 1/1974 | Hayden | 270/58 |

*Primary Examiner*—Robert W. Michell
*Assistant Examiner*—V. Millin
*Attorney, Agent, or Firm*—Carl E. Johnson; Vincent A. White; Richard B. Megley

[57] ABSTRACT

A mechanism for assembling and optionally joining flexible plies in predetermined relation. The workpieces, for example, may be shirt collar parts one or more of which may be of polyester material. The preassembling technique relieves an operator of the tediousness of trying to separate limp pieces and then accurately matching them. Plies picked singly and successively from the top of their respective stacks are deposited side by side on a reciprocable support maintaining their relative positions during transfer to a series of holders aligned heightwise with ply-receiving pallets constituting an intermittently operable endless conveyor. The support and holders cooperate to reposition the plies, if need be, on the holders. The arrangement is such that indexing the pallets continuously accumulates in registered, superposed relation the required number of plies of an assembly. The plies are usually next temporarily tacked or otherwise attached together at selected spaced points as by heating elements coordinated with conveyor indexing. The assembled unit is moved to an accumulating or stacking station from which the collection may be conveniently removed for further processing.

8 Claims, 15 Drawing Figures

Plate 58
Pist-Cyl, 50 for X,Z Plies
Pick up force
Pick up twist
work Release
Pist-Cyl, 50 for Y Plies
Pick up force
Pick up twist
Actuator 164
Clamps 176
Work Release
Vacuum to Plate 28
Plate 24
Air Jets
Vacuum to holders 24
Blow down to holders 24
Pallet 14
Conveyor Brake
tacker 122
Plates 144 up, down
Ends 134 open, closed
Y pick up with turn-over means

MACHINE FOR ASSEMBLING FLEXIBLE WORKPIECES

CROSS REFERENCE TO RELATED APPLICATION

The fabric pick-up means herein disclosed is essentially similar to that disclosed in a pending application Ser. No. 260,305 filed June 6, 1972 in the name of R. R. Walton et al. That application is accordingly incorporated herein by reference and has matured to U.S. Pat. No. 3,813,094.

BACKGROUND OF THE INVENTION

Pre-assembly of thin, flexible workpieces such as found in the garment industry and elsewhere is increasingly important to avoid inaccurate matching of parts and to attain greater productivity. Also, the burden of manually separating and then properly aligning such workpieces is to be shunned if they are to be subsequently joined without loss of productivity and of proper registration. This invention is accordingly directed to providing a method and apparatus for assembly from different stacks of flexible workpieces the individual perforate plies which are to be registered with one another, then uniting them at least temporarily in their registered relation, and lastly stacking the assemblies for further processing.

The invention will probably have primary use in the fabric and garment industries, but it is to be understood that usage of the invention is not thus limited. Also, the particular work joining mechanism herein optionally employed by ways of illustration is advantageous in that it conveniently employs heat for at least temporarily attaching (as by spot welding) the plies together, at least one of the plies being a polyester material; it will be clear, however, that the invention is in many respects not limited to use with the heat or other fastening feature, nor to use in dealing with a polyester ply. Moreover, though specifically illustrated as applied to shirt collar making usage of the invention is not necessarily restricted to use on fabric of particular type or for a particular purpose.

Multi-ply fabric assemblies, herein typified in the making of collars for mens' dress shirts, are commonly difficult to manipulate even when their parts are first registered with each other and, prior to that, the workpieces are not easily separated singly from their respective stacks formed usually by die cutting operations. As commonly known some fabrics are sleazy, some have greater body, and some are clingy while others slide easily; the great variety of their characteristics makes complex the provision of a sufficiently versatile machine for reliably assembling them in uniform predetermined relation. It is appreciated that a mechanized pre-assembly of collar plies, for instance, in precise superposed relation will greatly facilitate subsequent collar finishing operations when the plies are at least temporarily fastened together. The art of making mens' dress shirt collars has hitherto called for a mixture of non-skilled but burdensome operations (such as manually separating, positioning and spreading out each ply) with highly skilled maneuvers involved in maintaining the parts in registry while guiding the assemblage in precise manner relative to a needle to insure that seaming runs exactly a uniform distance from the edge of the three sides of the collar and stops at specified points. Occasionally stitch tacking at spaced points is made to aid an operator in uniformly moving the collar plies but then productivity is reduced by the need thereafter to snip and remove the temporary thread attachment.

In some superficial respects it may be noted that a general resemblance exists between the disclosure of U.S. Pat. No. 3,608,118 issued Sept. 28, 1971 on an application of Frederick J. Rex et al. and the illustrative apparatus herein to be described. An important distinction is that workpiece in the latter are previous necessitating unique positioning technique workpieces in the former the leather work is simply held in the desired position by suction. Accordingly the present invention features novel pneumatic work positioning means associated with each cooperating work transfer mechanism.

SUMMARY OF THE INVENTION

In view of the foregoing, it is a main object of this invention to provide a novel apparatus for pre-assembling flexible plies from their respective stacks, the plies of each assembly to be accurately registered with each other, optionally transitorily attached, and then accumulated in a manner facilitating further finishing operations.

Another object of the invention is to provide in a machine for successively registering a single fabric ply with at least one other ply, a reliable transfer mechanism for coordinating their rearrangement from juxtaposition to a superposed relation, and means for then attaching the superposed plies of each set.

A further and more specific object of this invention is to provide an apparatus and method for registering the plies of shirt collars, at least one ply of each set including a resin or being a polyester material, and then optionally temporarily attaching the ply sets of each collar as by heat bonding.

To these ends and as herein illustrated, a single top ply is lifted from each of a plurality of stacks arranged side by side, an adjacent, intermittently indexed conveyor comprises a series of ply-receiving pallets, a series of suctional work holders is arranged over a loading zone of the conveyor, transfer mechanism is reciprocably operable for delivering the picked-up plies to the respective holders, and the latter, synchronized with the conveyor indexing, successively deposit the plies in exactly superposed relation on the pallets. As herein shown, an optionally operable attaching means preferably in the form of spaced heat tacking tools is disposed for operation on the plies of an assembly on a pallet as it arrives at an indexed position. The successive assemblies are then automatically accumulated in orderly manner at a subsequent station, a stacking mechanism being disposed to unload each pallet and retain the assemblies in an ordered pile.

Since the initial stacks of plies as supplied to the apparatus cannot be relied upon to occupy precise positions, and it is impractical to expect that each ply of a stack will continue in constant, predetermined position in its stack or with respect to its matching ply in an adjacent stack, the mentioned work transfer means and suction holders are provided with cooperating means for insuring that upon release to a holder a workpiece will be urged thereon against a pre-set gage, the gages being disposed with respect to the individual holders so that exact work placement on each pallet is attained. Hence, a proper edge alignment or selected superposed overlying relation is derived prior to assembly tacking.

Optionally included in the assembly apparatus of the invention is a means likely to be useful in the garment trade, for instance, for inverting each of the plies to be transferred from one of the stacks.

BRIEF DESCRIPTION OF THE DRAWINGS

The foregoing and other features of the invention will now be more particularly described in connection with an illustrative shirt collar assembling apparatus, and with reference to the accompanying drawings thereof, in which.

DESCRIPTION OF PREFERRED EMBODIMENT

Figure 1:
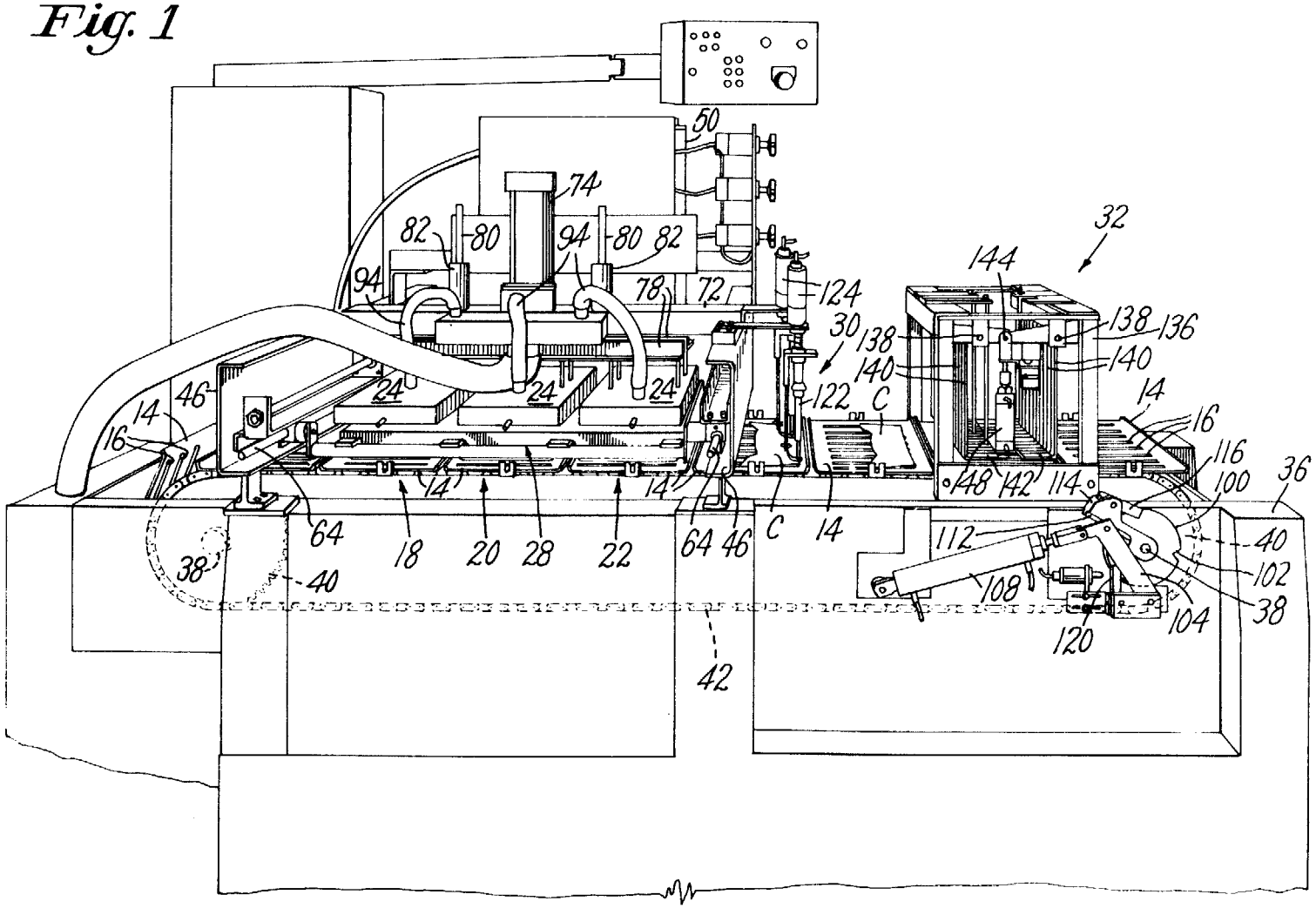
FIG. 1 is a view, largely in front perspective of a mens' shirt collar assembling apparatus, a pallet conveyor being indicated together with a series of work holders, an assembly tacker station, and a stacking or unloading station.
Figure 2:
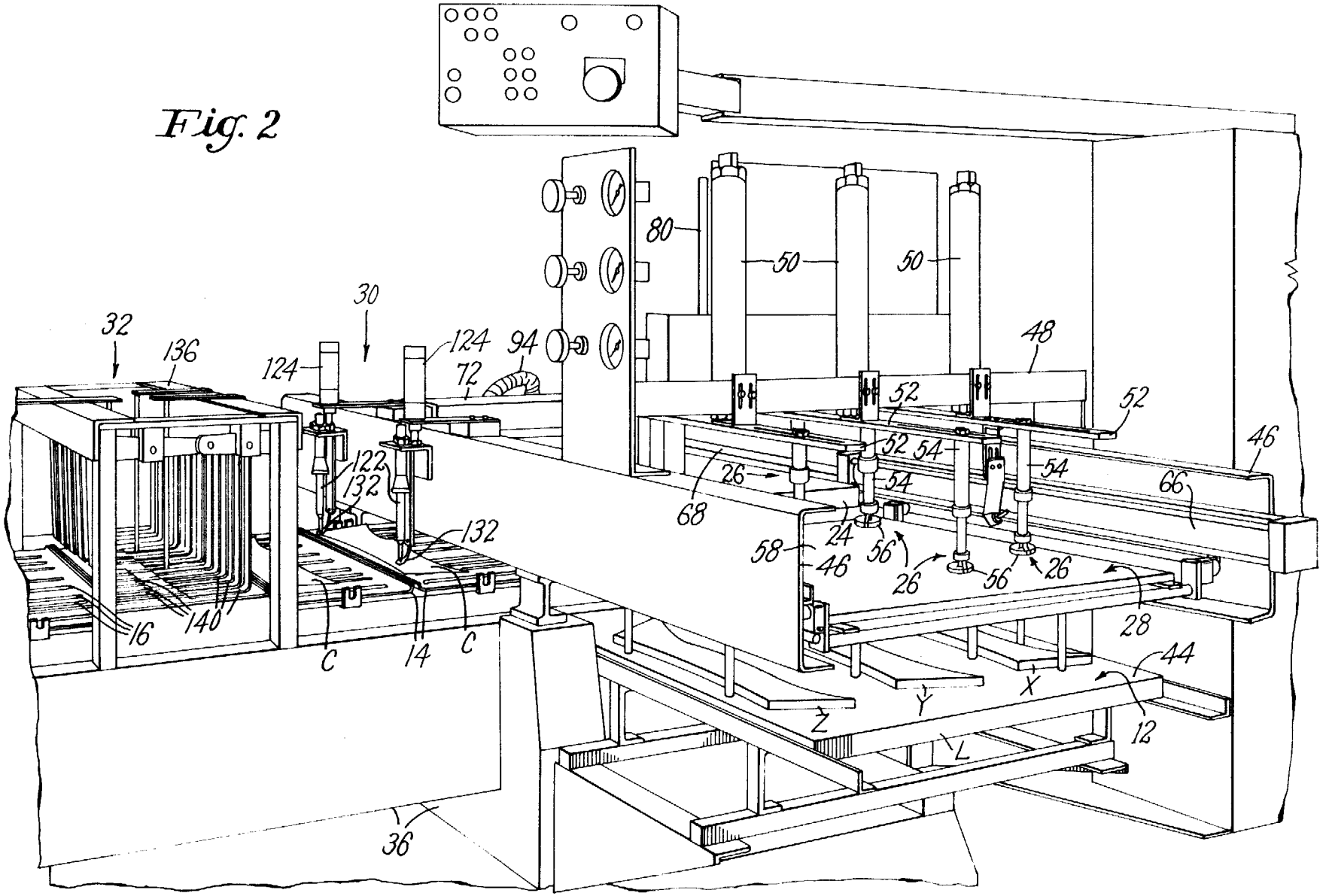
FIG. 2 is a perspective view from the rear of the apparatus shown in FIG. 1 and showing a series of pick-up devices above a work loading zone.

The embodiment of this invention as illustrated in FIGS. 1 and 2 comprises a plurality of stations operating in timed sequence to automatically assemble and register in superposed relation the several plies of a man's dress shirt collar generally designated C (FIGS. 3, 4 and 10), to secure the plies at least temporarily in their respective collar assemblies as a preliminary to further finishing steps, and then to accumulate the successively completed assemblies in an ordered stack.

Figure 10:
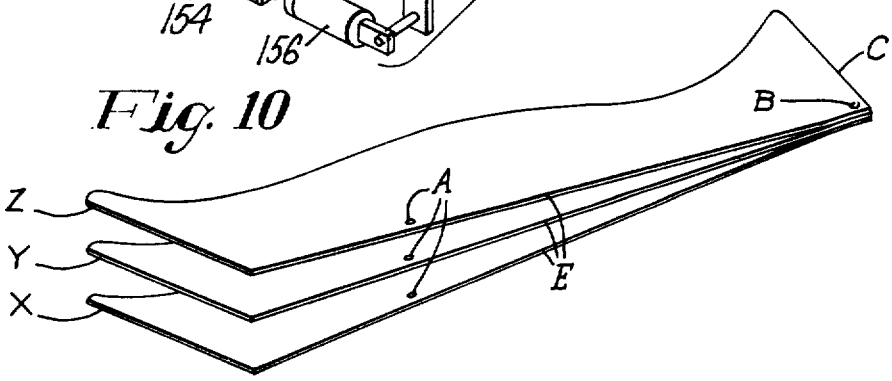
FIG. 10 is a perspective view of the collar plies as assembled in registered relation by the apparatus and here shown partly tacked and partly separated at previously tacked points.

The workpieces, in this case three plies of fabric designated X, Y, and Z (FIGS. 2 and 3) are received and supported in a loading station 12 at the rear of the machine. The X plies are stacked together and likewise Y and Z plies, respectively, as they would normally be received from a cutting die. In addition to being perforate, the plies may vary greatly in character though their shapes, but in this example, are substantially identical. It is common that one or more of the plies X, Y and Z will be of a polyester material, the Y ply herein being assumed to be a polyester lining or a cotton lining including a resin. Although, the ply stacks are spaced side by side and similarly oriented at the loading station 12, the collar assemblies C to be provided, as indicated in FIG. 10, require that a single ply from each stack be exactly registered in superposed straight edge relation preparatory to being secured together by means such as later described.

The loading station 12 is adjacent to the left end portion of the endless conveyor comprised of pivotally linked trays or pallets 14 respectively formed with slots 16 for a purpose later noted, and adapted to receive the plies X, Y, and Z in outspread superposed condition. The conveyor is indexable to shift the pallets 14 in unison rightward as viewed in FIGS. 3–6 inclusive in increments equal to the width of any one pallet 14, i.e., sufficiently to advance each pallet to the conveyor position just vacated by the preceding pallet 14. Coextensive with the left portion of the conveyor is a series of ply laying stations generally designated 18, 20 and 22 (FIGS. 3, 5, and 6) aligned with a succession of the dwell positions of three of the adjacent pallets 14. The stations 18, 20 and 22 respectively include a vertically reciprocable ply holder 24 wherein as later explained each ply is accurately positioned as desired and the usually minor "mispositioning" arising from original positioned irregularity of the plies in their respective stacks is corrected. For delivering successive plies from the loading station 12 to the stations 18, 20 and 22 as subsequently described in greater detail, a plurality of pick-up devices 26 cooperates with a transfer mechanism generally designated 28 and operable between the loading station 12 and the stations 18, 20 and 22.

Successive pallets emerging from the ply laying station 22 carry superposed collar plies to a tacking station designated 30 (FIGS. 3 and 4) and thence to a stacking station 32 which may constitute the last station along the conveyor. Operations of the stations 30, 32 will be more fully explained hereinafter.

Figure 5:
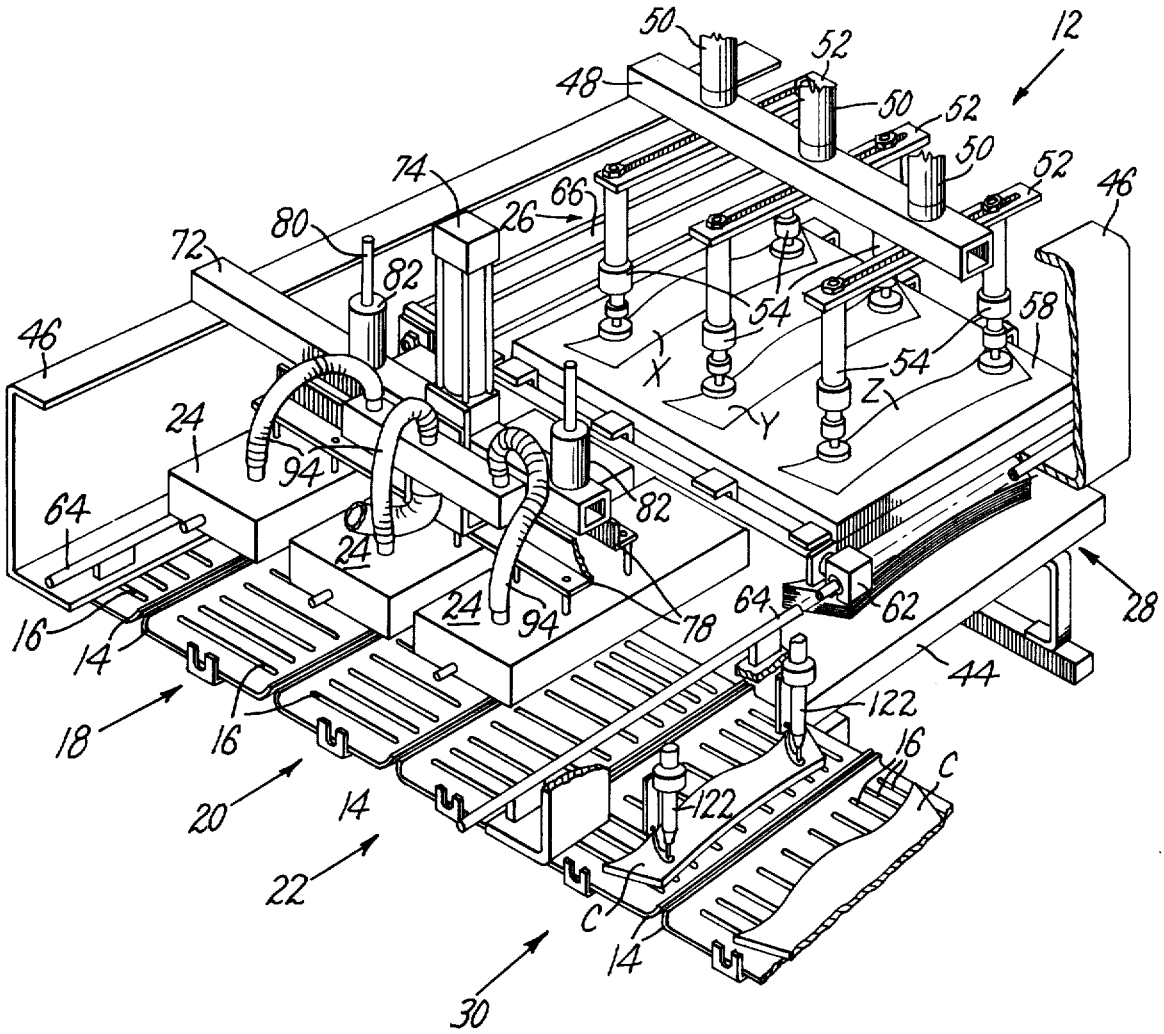
FIG. 5 is a view similar to FIG. 3 but showing the parts in a next stage, the work transfer mechanism being retracted for reloading and the conveyor again indexed.
Figure 6:
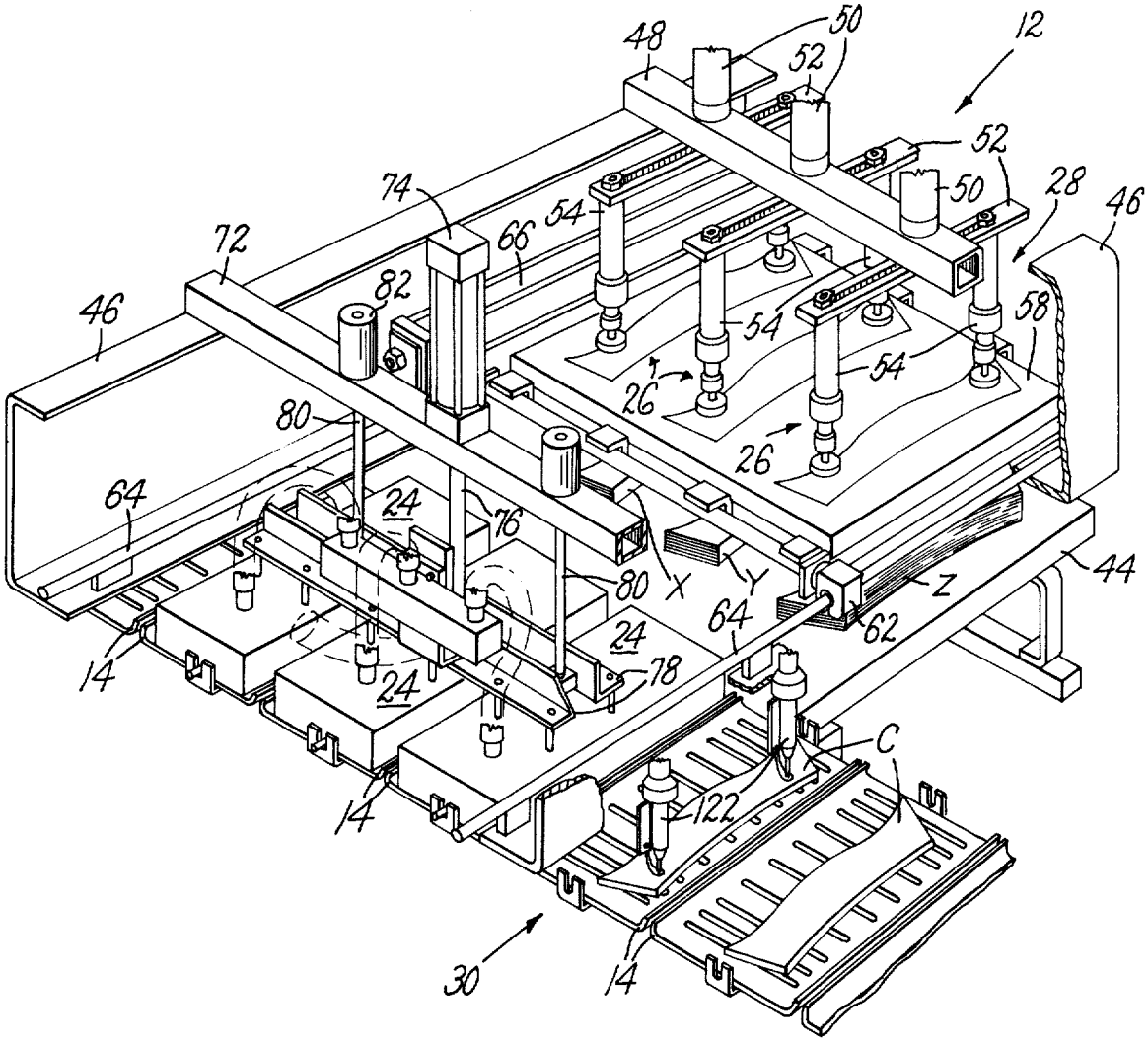
FIG. 6 is a view similar to FIGS. 3 and 5 but taken at a later stage of the operating cycle wherein the work holders have descended to transfer the work plies to the respective conveyor pallets.

Referring to FIGS. 1 and 2, a main frame 36 for supporting the above mentioned apparatus provides bearings at opposite ends in which shafts 38 (one only shown in FIG. 9) are journalled for rotatably supporting sprockets 40 driving parallel endless chains 42, 42 (one only shown in FIG. 9) to which the series of pallets 14 is connected at their opposite ends. The loading station 12 comprises a platform 44 (FIG. 2) bracketed to the frame 36 for supporting the similarly oriented stacks X, Y, and Z in juxtaposition. Disposed above and transversely of the path of the conveyor is a pair of spaced, U-shaped cross beams 46, 46. For lifting successive single plies from the top of each of the stacks simultaneously, a channel bar 48 is secured across the tops of the U-beams 46 and carries three piston-cylinder devices 50, each piston supporting a bar 52 for adjustably supporting, respectively, substantially identical sets of the pick-up devices 26 respectively comprising piston-cylinder mechanism 54. The bar 52 is longitudinally slotted to receive nuts for adjustably accommodating the respective mechanisms 54. Each pick-up device 26 is desirably, though not necessarily, the substantial equivalent of that fully disclosed in FIGS. 14–18 inclusive of the U.S. Pat. No. 3,813,094 referred to above. Accordingly, details of the pick-up structure are not herein fully described it sufficing for present purposes to note that they are preferably essentially of the pneumatic piston-cylinder type and comprise a presser foot 56 and a cooperating pinch pawl (not shown) which twist the fabric locally to effect interfacial separation. Upon the devices 50 being pressurized to lower the bars 52 with the mechanisms 54, the respective presser feet 52 descend into work engagement and a top ply of each stack is seized at spaced points. Retraction upwardly of the presser feet 52 is accompanied by their rotation to locally contort and seize the topmost ply, thus separating it from the remainder of the stack. Now the devices 50 raise the separated top ply as shown in FIG. 5 to a position such that they may be automatically released and deposited on a reciprocable suction plate 58 of the transfer mechanism 28 as shown in FIG. 6. Simultaneous release of the single plies X, Y, and Z, is effected by the depressurizing of the mechanisms 54.

The plate 58 is hollow and adapted to transfer the plies from the rearward position above the loading station 12 to the ply laying stations 18, 20, and 22, respectively, as will next be explained. The plate 58 has its upper or work supporting surface formed with small spaced holes 60 (FIGS. 7, 8) whereby suction applied to the interior of the plate is adequate to retain the outspread work during transfer. The plate 58 is provided at opposite sides with spaced bearing blocks 62 supplied to slidably receive spaced parallel guide rods 64, 64 respectively secured to the interior of the cross beams 46. Accordingly, reciprocation of the transfer plate 58 is timed with the operation of the devices 26 and the other stations 18, 20, 22, 30 and 32, an air cylinder 66 (FIGS. 3, 5 and 6) being affixed to the frame 36 and having its piston rod 68 connected to the plate 58 for this purpose.

Figure 3:
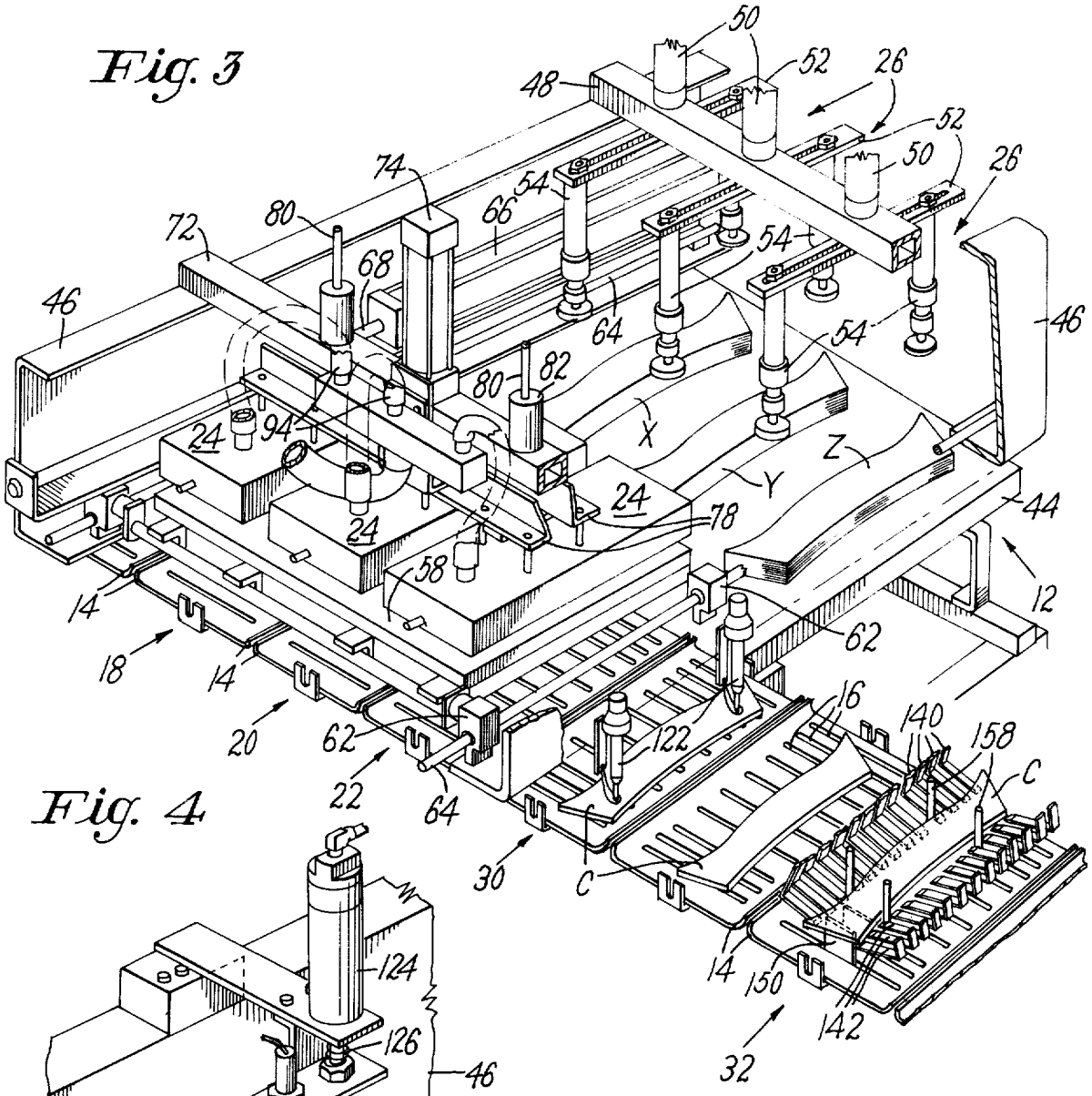
FIG. 3 is another perspective view, with portions broken away, of a portion of the apparatus shown in FIGS. 1 and 2, the pick-up devices being in their elevated positions, a work transfer mechanism being advanced to its transfer position intermediate the holders and the conveyor, and a ply assembly being tacked at a station prior to delivery at an accumulator station.

At the forward or delivery end of the stroke of the transfer plate 58, the latter overlies the ply laying stations 18, 20 and 22 and underlies the vertically reciprocable ply holders 24 as shown in FIG. 3. It is important to note that since the plies in their original stacks X, Y and Z cannot be relied upon to occupy exactly uniform positions, the transfer mechanism incorporates a ply position correcting or refining mechanism 70 (FIGS. 7 and 8) automatically operable to insure that the plies, on being assembled, will register as desired. Each ply holder 24 is in the form of a vertically reciprocable suction box aligned with a dwell position of a pallet 14. For this purpose a cross bar 72 secured on the forward portions of the U-beams 46 centrally carries a piston-cylinder device 74. Its piston rod 76 (FIG. 6) is connected to braces 78 carrying the suctional ply holders 24. For insuring that each holder 24 is held aligned with a dwell position of a pallet 14, a pair of guide rods 80 (FIGS. 3, 5, and 6) preferably is slidable in spaced bearings 82, respectively, mounted on the bar 72, the lower ends of the rods 80 being affixed to the braces 78.

Figure 7:
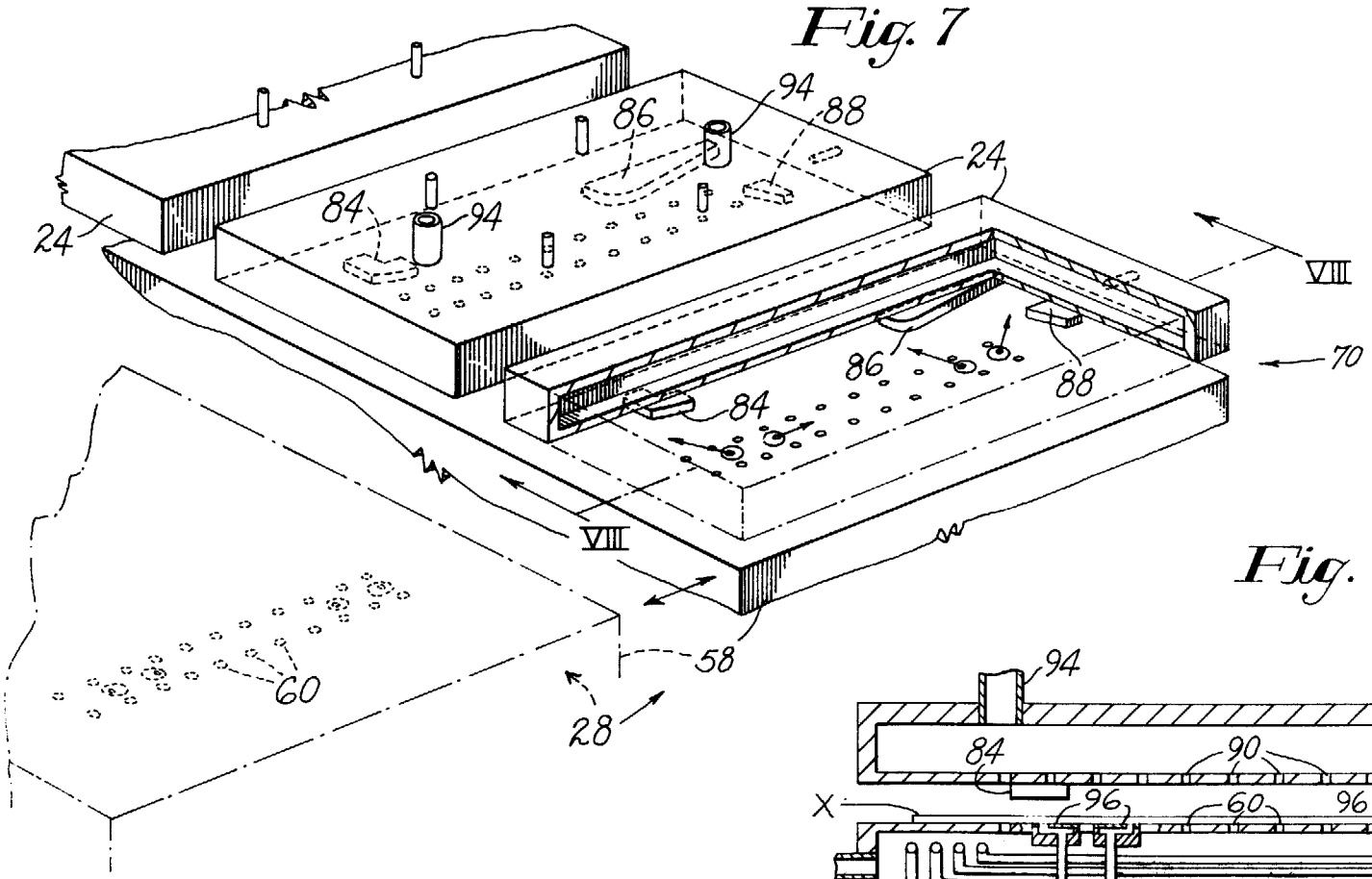
FIG. 7 is a perspective view showing the manner of cooperation of the work transfer mechanism in the holders in establishing desired registry of the plies.
Figure 8:
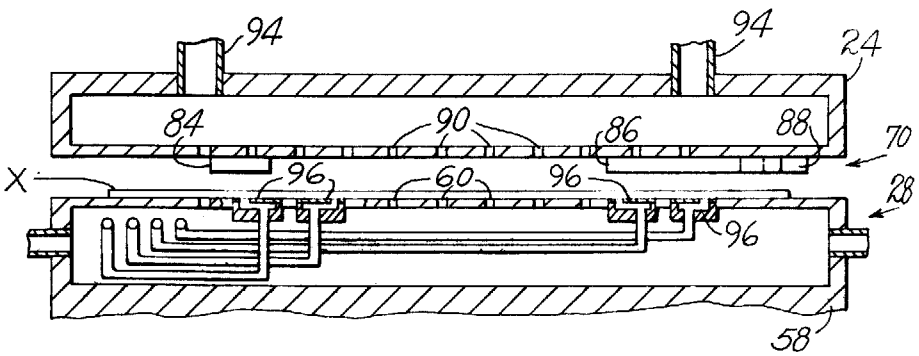
FIG. 8 is a section taken on the line VIII—VIII of FIG. 7.

In this case, the desired ply registry is the alignment of the straight edges of the respective plies of a set. Accordingly, referring more particularly to FIGS. 7 and 8 each holder 24 is fitted on its underside with similarly arranged stops or edge gage means which are in the form of blocks 84, 86 and 88. These may be adhesively attached or otherwise adjustably mounted in the event it is desired to modify the desired ply registry to one of overlapping only by a predetermined margin, or having one ply oriented at a prescribed angle relative to another, etc. The undersurface partly bounded by the gage blocks 84, 86 and 88 is formed with perforations 90 preferably disposed in an outline smaller than the collar ply and substantially corresponding to the similarly disposed vents provided in the transfer plate 58. Suction to the latter is maintained only until the ply loaded plate 58 arrives beneath the holders 24 as shown in FIG. 7, whereupon suction to the holders 24 becomes effective via conduits 94. Then, too, pulsed air jets are also emitted from nozzles 96 in the plate 58, and directed mainly horizontally and laterally of each ply as shown in FIGS. 7 and 8. Desirably, the pulsed air streams in at least two instances urge the ply toward the side gages 84, 86; in one instance the ply is impelled toward an end gage 88; and a fourth nozzle is aimed toward an "open corner" defined by the gages. The result is a transfer of each ply from the plate 58 to the holders 24 and into predetermined relative positions required for precise assembly. Reciprocal vertical movements of the holders 24 is coordinated with the horizontal reciprocation of the transfer plate 58 as indicated in the timing chart, FIG. 12.

Figure 12:
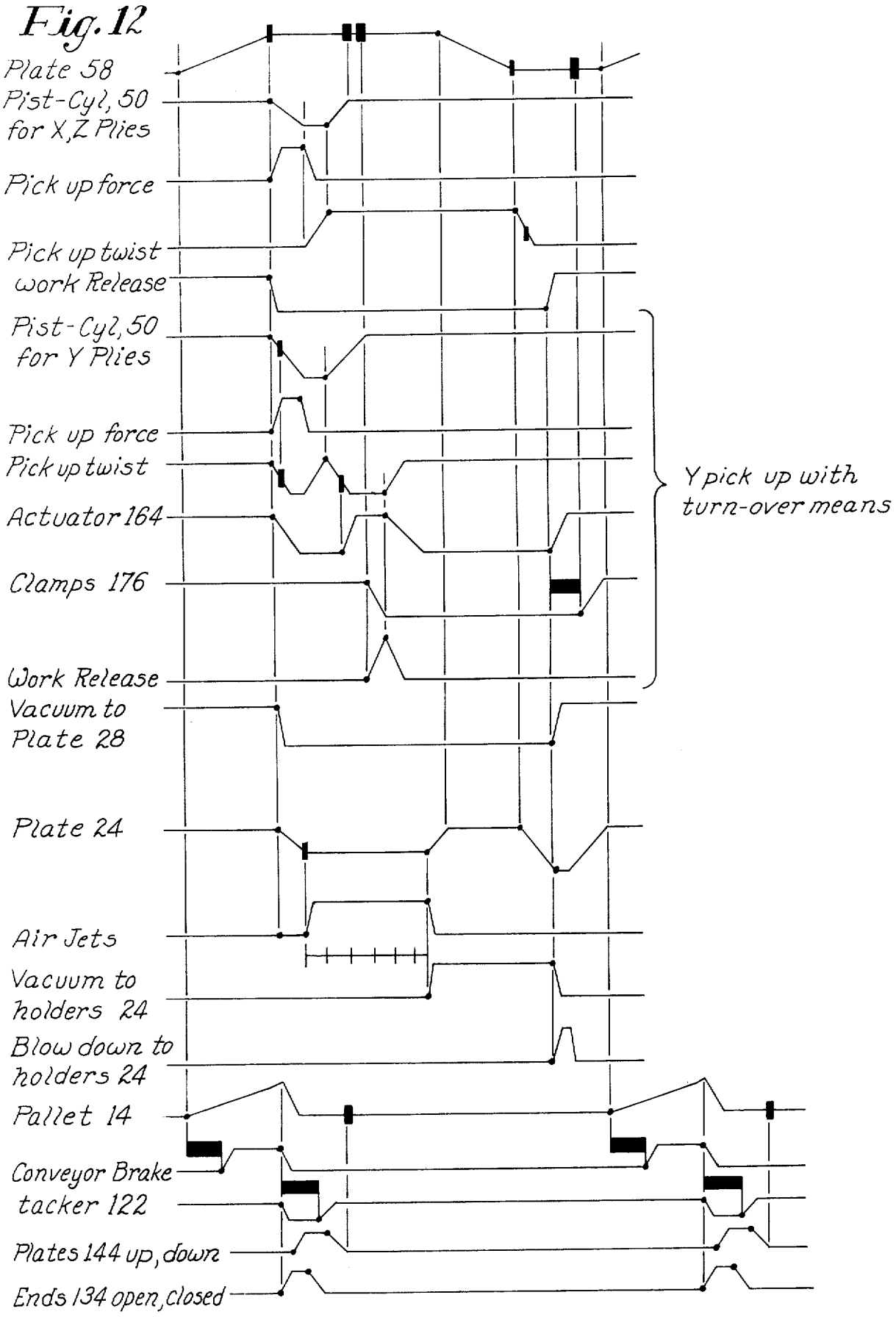
FIG. 12 is a timing chart for the several mechanisms of the apparatus.

Upon descent of the holders 24 to the ply laying stations 18, 20 and 22 respectively, the suction to the holders is discontinued, air blow down is applied as shown in FIG. 12, and the single plies are respectively disposed simultaneously in proper positions the pallets 14 then occupying dwell positions at the stations 18, 20 and 22. It will be understood, that, in order to prepare the apparatus for fully automatic operation, certain of the pick-up devices 26 may be manually disabled, and hence the control system initially enables the X ply laying station 18 to be empty, one ply Y has been deposited on the station 20 and X and Y plies have been superposed on the pallet at station 22. The next cycle, upon indexing the conveyor, accordingly allows the station 18 to receive one X ply; station 20 superposes a Y ply on an X ply; and station 22 superposes a Z ply on the previously superposed X and Y plies. At each of the ply laying stations the straight edges E (FIG. 10) of the plies are exactly aligned as determined by the gage means above mentioned.

Figure 9:
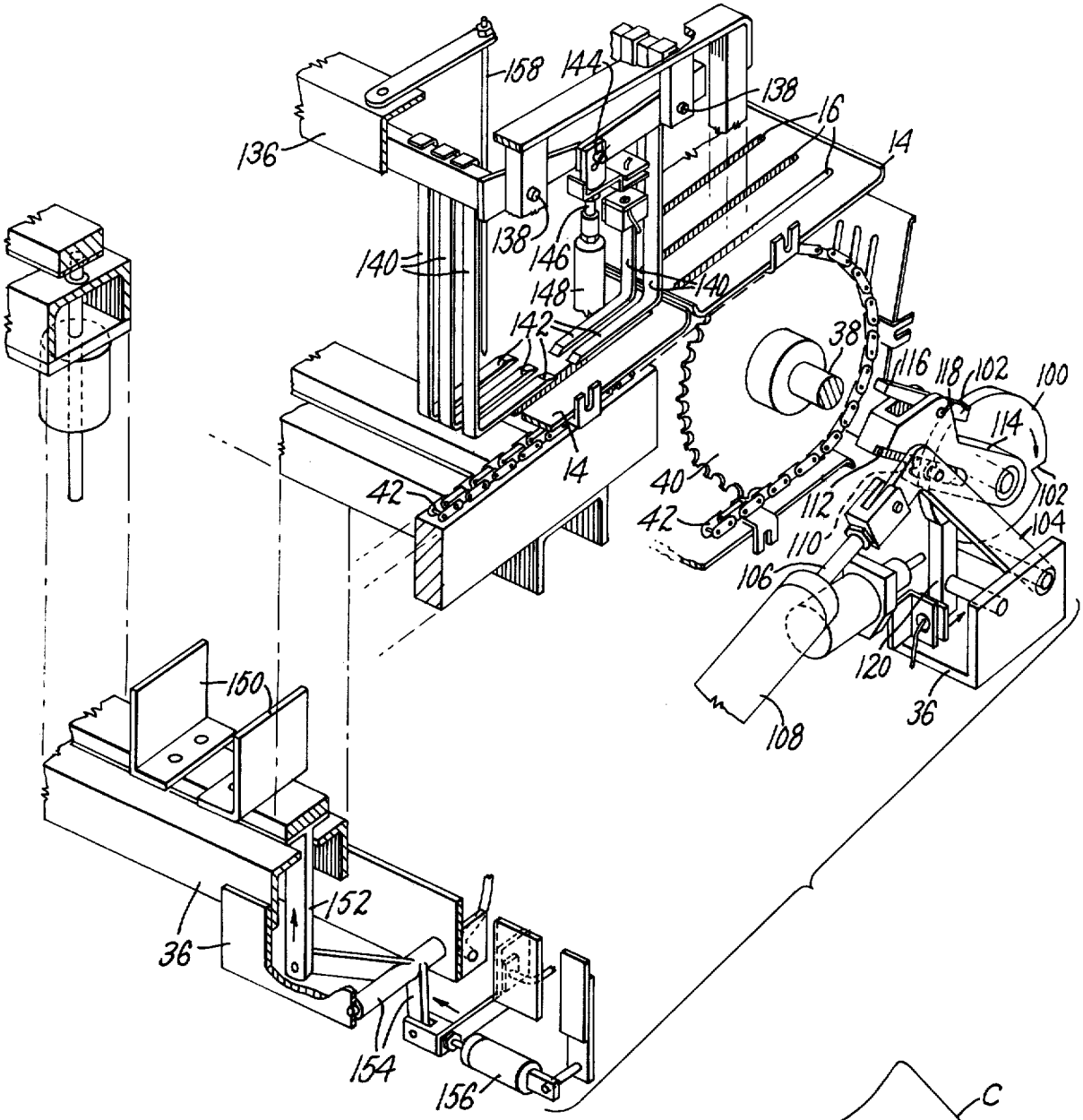
FIG. 9 is a perspective view of stacking means and indexing means for the conveyor.

While a variety of conveyor indexing means may be used, there is herein shown in FIG. 9 an exemplary arrangement now to be briefly described. On an end of the shaft 38 there is keyed a disc 100 having three equally spaced circumferential notches 102. A lever 104 pivoted at one end to the frame 36 is oscillatable by a piston rod 106 pivotally connected to the other end of the lever 104, the rod 106 being actuated by a two-way fluid pressure driven cylinder 108. Air is admitted to the cylinder 108 as dictated by the control system to effect conveyor stepping of the pallets 14 as indicated by the timing chart (FIG. 12). The lever 104 carries a roll 110 which slidably cooperates with a track 112 formed on a lever 114. The latter is fulcrummed on the shaft 38 and pivotally carries a pawl 116 on a pin 118. The arrangement is such that an end of the pawl 116 engages in a notch 102 to rotate the disc 100 clockwise 120° each time the pallets 14 are advanced to the right and away from their prior dwell positions. A spring urged detent 120 (FIG. 9) engages another notch 102 at the end of each step to prevent movement of the pallets when in their dwell positions and during return or counterclockwise movements of the lever 94. A brake may also be applied to prevent over stepping by controlling conveyor deceleration.

Figure 4:
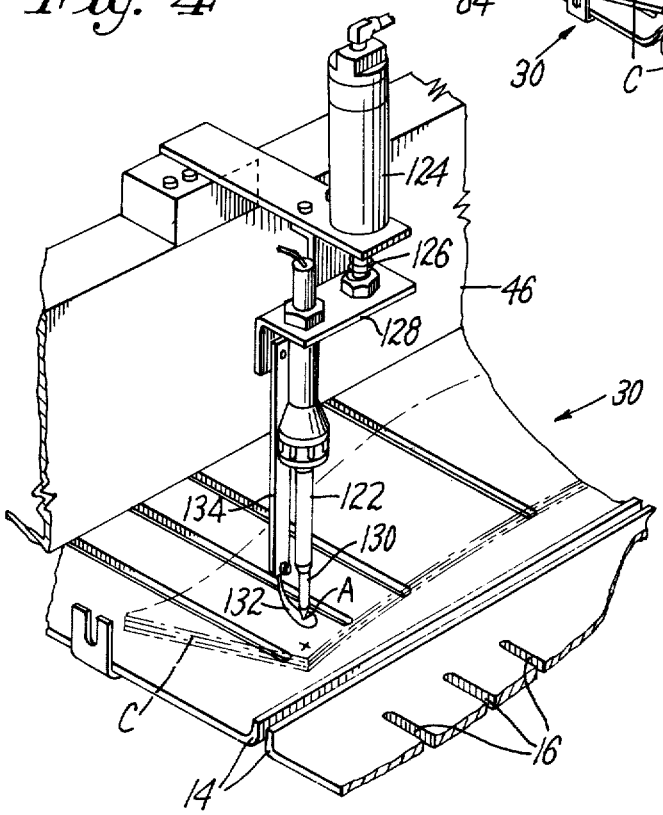
FIG. 4 is an enlarged perspective of one of the tackers shown in FIG. 3.

Upon being indexed from the station 22 three superposed plies X, Y and Z are next moved with the pallet 14 to the tacking station 30 (FIGS. 3 and 4). Here a pair of spaced heat tacking devices each generally designated 122, when employed, is automatically operable during the dwell to engage and preferably severably join the collar plies as at spots A and B (FIG. 10). One of the devices 122 will now be described with reference to FIG. 4. An air cylinder 124 bracketed to the U-beam 46 has a vertically reciprocable piston rod 126 carrying a bracket 128. Mounted on the bracket 128 are a pointed electric heat welding rod 130, and a combination hold-down and ply-stripping means in the form of a yieldable looped wire 132. This wire is supported from the bracket 128 by a bar 134 and is disposed yieldably to engage the top ply about the tiny hole of work penetration made by the conical end of the rod 130. The heat of this rod thus acts on the polyester ply (or plies) to temporarily join the collar parts in assembled relation. Desirably electricity for heating may be applied to the welding rods 130, 130 only for the interval, and for the intensity required for localized fusing during the dwell, when the pressurized cylinder 124 is lowering its rod 126 to effect ply penetration. Attention is invited to the fact that one of the tacker rods is arranged to operate on aligned collar points B, and the other tacker 122 is spaced to operate on a margin at A, a distance from the other collar extremity. The reason for this is to allow the fabric even distribution due to any minor irregularity of alignment prior to a marginal seam extending to such extremity.

Having been assembled as a unit C for further collar operations, the successive units are next advanced to the stacker station 32. Referring mainly to FIG. 9, an open box-like container frame 136 is mounted on the main frame 36 and in vertical alignment with a pallet dwell position downstream from the tacking station 30. A pair of parallel fulcrum rods 138, 138 is mounted in the container frame 136 to extend transversely of the path of the conveyor. A plurality of L-shaped levers 140 are suspended from each of the rods 138 and have in-turned spaced apart, bevelled lower ends 142 adapted to receive and support successive bottom-most plies of a stack of the completed units C. The adjacent upper ends of the outer levers 140 are connected to a toggle pin 144 which is movable heightwise by a piston rod 146 of a piston-cylinder device 148 to control movement together and apart of the stack supporting ends 142. The arrangement desirably is such that when a collar unit arrives on a pallet 14 at its dwell position in the station 34, ply lifting mechanism is automatically actuated to transfer the newly assembled unit to the bottom of the previously stacked units C resting on the closed lever ends 142. For this purpose a pair of spaced pushed plates 150, 150 (FIG. 9) is secured on the upper end of a link 152, the lower end of which is pivotally connected to one arm of a bell crank lever 154 journalled in the frame 36. The lever 154 is oscillated by an air motor 156 actuated in time relation to the conveyor indexing by the control system and connected to another arm of the bell crank lever whereby the plates 150 are projected upwardly through the slots 16. The motor 156 is coupled to the frame 36. A collar assembly unit is accordingly thrust upwardly from the pallet 14, between the open lever ends 142, to upwardly displace the stack, the levers thereupon closing to hold the unit in line with the accumulated stack, as the pusher plates now descend to an out-of-the-way position beneath the path of the pallets. For constraining the accumulating stack a plurality of spaced, vertical pins 158 adjustably depend from the top of the frame 136.

It will be understood from the foregoing that collar production may be continuous, the initial juxtaposed stacks X, Y, and Z being converted into collar assembly units C in superposed relation. Each time the pallet 14 passes through a ply laying station 18, 20, or 22 another ply is deposited in predetermined position by a holder 24. The assembled units C can be successively tacked together at station 30 and then, as thus preassembled, accumulated at the station 32 until it is desired to remove them for further processing.

Figure 11A:
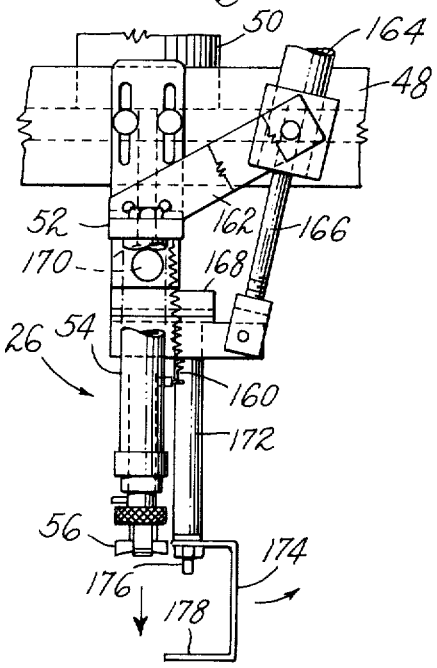
FIGS. 11*a*–11*d* inclusive are sequence views of mechanism optionally available with the pick-up devices for inverting workpieces from one stack.
Figure 11C:
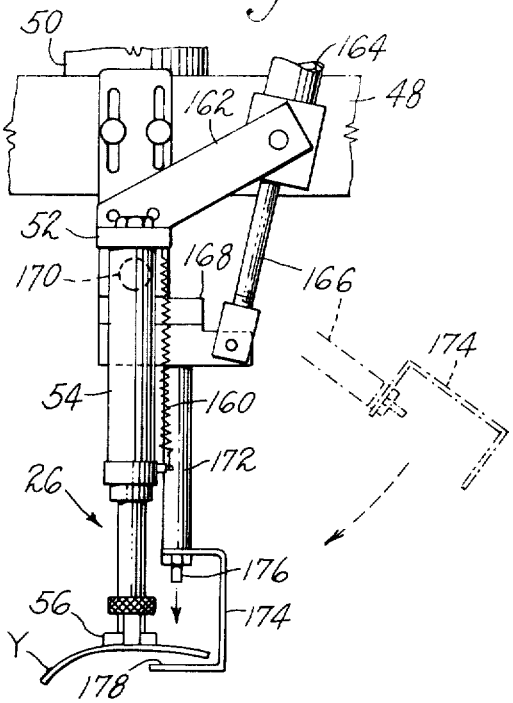
Figure 11B:
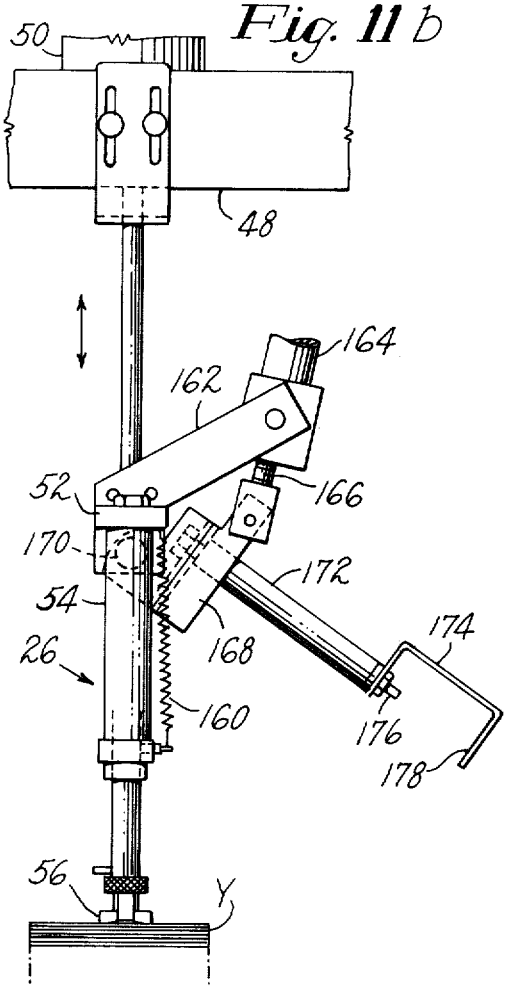
Figure 11D:
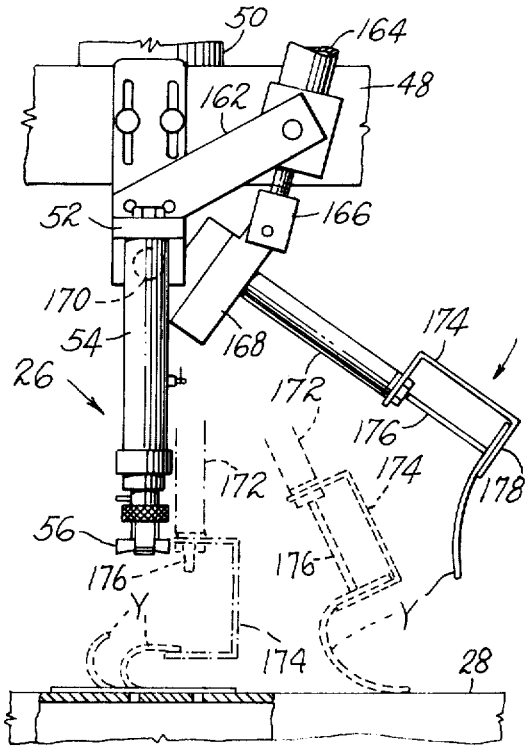

As above mentioned, there are occasions when it is desirable to turn over successive plies of a stack of fabric prior to its registration in an assembly. In the case of colored or patterned piece goods that have a "face" side, for instance, the plies will be loaded onto the platform 44 with their face side up. This means that subsequently when the collar is turned, as is usually necessary, one collar ply would be upsidedown. This situation can not be resolved merely by inverting a whole stack since non-matching shade problems could then arise. A solution is provided by employing in conjunction with each of the pick-up devices 26 operating on a stack, for instance the Y stack, an inverting mechanism to be described with reference to FIGS. 11*a* – 11*d*. It will be understood that the control system otherwise applicable to the pick-up devices 26 for stacks X and Z is suitably modified for the controlled actuation of the devices 26 operating on the stack Y. In FIG. 11*a* an elevated presser foot 56 of the pick-up 26 is being pneumatically lowered by its device 50 into engagement with a top ply Y as shown in FIG. 11*b*, and against resistance of a return spring 160. A whisker sensor or other sensing means is employed for suitably limiting downward travel of the pick-up device. In progressing from the work engagement condition of FIG. 11*b* to the top ply separated condition of FIG. 11*c*, a chamber in the pick-up is depressurized on signal from the sensor to allow operation of the spring 160 so that the seized ply is upwardly retracted. Secured to the bar 52 is a forked bracket 162 adjacent each of the Y pick-ups 26 for supporting an air cylinder 164. The lower end of a piston rod 166 operated by the cylinder 164 is pivotally connected to a lever 168 itself pivoted on a pin 170 affixed to the bar 52. The lever 168 carries a piston-cylinder device 172 having a U-shaped margin gripping jaw 174 cooperative with a free end of a piston rod 176 projecting from the device 170. The arrangement is such that when the ply is seized as in FIG. 11*b*, the gripper 174, 176 has swung to an out-of-the-way position, but when the separated ply has been lifted as shown in FIG. 11*c*, the open gripper 174, 176 has been swung back to a vertical position allowing the piston rod 176 to clamp the margin of the ply on a shelf portion 178 of the jaw 174. Now, the presser foot releasing the ply Y and the ply margin being similarly held clamped by a second and similar ply inverting means associated with another Y ply pick-up 26, the pairs of grippers 174, 176 swing outwardly from the vertical allowing the collar ply to hang dependent. The grippers then swing back inwardly, flipping the ply over and causing it to lie inverted upon the transfer plate 58 as indicated in dash lines in FIG. 11*d*. The transfer plate 58 then commences its travel toward the holders 24, the grippers 174, 176 having finally released the margin at their vertical positions.

The illustrative apparatus is desirably under fluidic controls though it will be understood that other control mechanism may be employed in whole or in part. Having made appropriate initial setting up adjustments, an operator will normally find that his attendance of the apparatus is chiefly devoted to replenishing the stacks X, Y and Z, and removing the assembled units C from the stacking station 32.

Having thus described my invention, what I claim as new and desire to secure by Letters Patents of the United States is:

1. Apparatus for assembling flexible perforate plies in predetermined relation comprising means for supporting in juxtaposition a plurality of stacks of the plies to be assembled, indexable conveyor mechanism including a plurality of pallets respectively arranged to be successively shifted into the dwell positions vacated by preceding pallets, a plurality of ply holders movable between ply receiving positions and ply delivery positions aligned with a series of the indexed pallets, a corresponding plurality of pickup devices movable for separating and removing single plies successively from their respective stacks on said supporting means, a transfer mechanism reciprocable between a position for receiving plies from the pickup devices and a position intermediate the ply holders and a series of the indexed pallets, each of the holders having a means cooperative with said transfer mechanism for predeterminedly positioning each ply received from said transfer mechanism and holding said ply in said predetermined position prior to deposit by the holders on said indexed pallets respectively, and control mechanism for coordinating in cyclical movement said pickup device, said transfer mechanism, the holders, and said conveyor.

2. Apparatus as in claim 1 wherein the positioning means on each of the holders comprises an adjustable edge gauge disposed on the underside thereof, and nozzle means on said transfer mechanism positioned for directing one or more pulsed air streams laterally of a ply for urging it against said edge gauge when the ply is transferred to the holder.

3. In apparatus for assembling fabric plies in predetermined registry, a loading station for receiving in juxtaposition stacks of the respective plies, and means for converting the juxtaposed plies to sets of at least partly superposed plies consisting of a single ply from each stack, said converting means comprising an indexable conveyor spaced from the loading station and comprising a plurality of pallets successively positionable in the dwell position of preceding pallets of the plurality, respectively, pickup devices operable above each stack, ply holders reciprocable in synchronization with the conveyor between a ply receiving position and a ply delivery position aligned with dwell positions of adjacent pallets, and transfer means movable between said pickup devices and said ply holders for transferring plies from said pickup devices to said ply holders with said ply holders in their ply receiving positions, a gauge means on the holders for positioning of the plies thereon relative to the holders and with respect to their said adjacent pallets in their dwell positions, and means cooperative with the holders for urging the respective plies being transferred thereto to abut the gauge means edgewise.

4. An assembling apparatus as in claim 3 wherein each of the ply holders is adapted to retain successive fabric plies by suction, and said means urging the plies to abut the gauge means comprises means mounted on said transfer means for directing air flow substantially toward a ply during transfer from said transfer means to a ply holder.

5. An apparatus as in claim 4 wherein control valving associated with each holder is automatically actuatable to terminate suction thereto during dwell of an adjacent pallet to effect delivery thereto of a positioned ply.

6. Multi-ply collar making apparatus comprising a loading station for supporting in similarly oriented stacks the plies of collars to be assembled therefrom, an indexable conveyor movable in a path spaced from the loading station, said conveyor including a plurality of pallets respectively adapted to receive a ply and then be successively shifted into the dwell position vacated by a preceding pallet, ply pickup devices operable above each stack at the loading station, suctional ply holding devices reciprocally operable between receiving and deposit positions aligned with a series of dwell positions of said pallets, transfer means laterally movable between the pickup devices and the suctional ply holding devices for transferring successively picked up plies from said transfer means to predetermined positions on the undersurface of the respective suctional devices, and control means for cyclically operating said devices and said transfer means in time relation to the conveyor indexing.

7. Apparatus as in claim 6 wherein said surfaces of the suctional devices have edge gages in adjustable parallel relation, and air jet impelling means mounted on the upper surface of the transfer member and arranged yieldingly to urge corresponding edges of the transferred plies against the edge gages respectively.

8. In apparatus for assembling fabric plies, at least one reciprocable pickup device movable into and out of pickoff relation with respect to a stack of the plies, said device comprising a first piston-cylinder means including a relatively movable ply seizing means for seizing a ply and subsequently releasing the seized ply when it has been removed from the stack, and a ply turnover mechanism associated with the device, said mechanism comprising a second piston-cylinder means pivotally mounted for movement about an axis extending transversely of the first piston-cylinder means for seizing a margin of the ply before it is released by said member, and control means for pivotally operating the ply turnover mechanism in time relation to operation of said first piston-cylinder means whereby the ply released by the latter is inverted and then released by said second piston-cylinder means.

* * * * *